US008698034B2

(12) United States Patent
Ryu

(10) Patent No.: US 8,698,034 B2
(45) Date of Patent: Apr. 15, 2014

(54) VACUUM INTERRUPTER

(75) Inventor: Jae Seop Ryu, Chungcheongbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 456 days.

(21) Appl. No.: 13/101,057

(22) Filed: May 4, 2011

(65) Prior Publication Data

US 2011/0278262 A1 Nov. 17, 2011

(30) Foreign Application Priority Data

May 13, 2010 (KR) ..... 10-2010-0045132

(51) Int. Cl.
*H01H 33/662* (2006.01)

(52) U.S. Cl.
USPC ..... 218/136; 218/134

(58) Field of Classification Search
USPC ..... 218/118, 134–139
See application file for complete search history.

(56) References Cited

U.S. PATENT DOCUMENTS 3,903,386 A * 9/1975 Yanagisawa ..... 218/136
4,224,550 A * 9/1980 Rich ..... 218/118

FOREIGN PATENT DOCUMENTS

| | | |
|---|---|---|
| EP | 1005058 | 5/2000 |
| FR | 2887683 | 12/2006 |
| GB | 1027786 | 4/1966 |
| JP | 53146179 | 12/1978 |
| JP | 54056173 | 4/1979 |
| JP | 56-3916 | 1/1981 |
| JP | 56026271 | 6/1981 |
| JP | 56117444 | 9/1981 |
| JP | 64-41132 | 2/1989 |
| JP | 5-94480 | 4/1993 |
| JP | 10-21802 | 1/1998 |
| JP | 10021802 | 1/1998 |

OTHER PUBLICATIONS

Japan Patent Office Application Serial No. 2011-107497, Office Action dated Sep. 18, 2012, 3 pages.
The State Intellectual Property Office of the People's Republic of China Application Serial No. 201110129944.5, Office Action dated Jun. 19, 2013, 7 pages.

* cited by examiner

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

A vacuum interrupter is provided. As a main shield and sub shields are installed in an overlapping manner, an equipotential distribution can be mitigated and thusly a dielectric strength can be enhanced. Also, as a curved portion is formed at each end of the shields, concentration of an electric field at an end of each shield can be prevented and accordingly an electric field value can be lowered. Consequently, the dielectric strength can be remarkably enhanced, resulting in an effective prevention of a dielectric breakdown.

15 Claims, 8 Drawing Sheets

VACUUM INTERRUPTER

CROSS-REFERENCE TO RELATED APPLICATION

Pursuant to 35 U.S.C. §119(a), this application claims the benefit of earlier filing date and right of priority to Korean Application No. 10-2010-0045132, filed on May 13, 2010, the contents of which is incorporated by reference herein in its entirety.

BACKGROUND OF THE INVENTION

1. Field of the Invention

This specification relates to an inner shield for a vacuum interrupter.

2. Background of the Invention

An inner shield for a vacuum interrupter, to which the present disclosure is applied, is used for a high-pressure/ultra high-pressure vacuum interrupter. As a rated voltage of the vacuum interrupter increases, a dielectric strength level required increases and accordingly the vacuum interrupter is elongated.

The high-pressure/ultra high-pressure vacuum interrupter may have limitation to improving a dielectric strength in the existing structure of having a single center shield. Considering such limitation, an inner shield structure capable of reducing the size of the high-pressure/ultra high-pressure vacuum interrupter by improving the dielectric strength has been introduced in recent time.

FIG. 1 is a longitudinal sectional view showing a structure of a typical vacuum interrupter.

As shown in FIG. 1, in the structure of the related art vacuum interrupter, a dielectric casing 1 is sealed with a fixed flange 2 and a movable flange 3, and a stationary electrode 4 and a movable electrode 5 contactably face each other within the dielectric casing 1 and are housed within an inner shield 6 fixed to the dielectric casing 1. Also, a stationary shaft 4*a* of the stationary electrode 4 is connected to the exterior with being fixed to the fixed flange 2, and a movable shaft 5*a* of the movable electrode 5 are connected to the exterior with being slidably coupled to the movable flange 3.

A bellows shield 7 is fixed to the movable shaft 5*a* of the movable electrode 5. A bellows 8 is disposed between the bellows shield 7 and the movable flange 3 to allow the movable electrode 5 and the movable shaft 5*a* to be movable in a sealed state within the dielectric casing 1.

The inner shield 6 is located at a position where the stationary electrode 4 and the movable electrode 5 are symmetric to each other when both of the electrodes 4 and 5 are completely open. The inner shield 6 prevents reduction of a dielectric strength, which is caused as metal vapor, which is dispersed upon arc generation at a breaking operation, is absorbed on an inner surface of the dielectric casing 1.

FIG. 2 is a longitudinal sectional view showing another exemplary structure of a vacuum interrupter according to the related art.

The high-pressure vacuum interrupter shown in FIG. 2 has a structure that a stationary-side sub shield 12 and a movable-side sub shield 13 are further installed at both sides of a main shield 11 in an axial direction to overlap the main shield 11. The like/similar portions to FIG. 1 have the like/similar reference numerals.

In this structure, the vacuum interrupter is formed such that a diameter at a side of an electrode of the sub shields 12 and 13 is smaller than that of the main shield 11. The vacuum interrupter further includes the sub shields 12 and 13 in addition to the main shield 11 to mitigate an equipotential distribution, thereby improving a dielectric strength.

However, in the structure of the vacuum interrupter having those sub shields, ends of the sub shields 12 and 13 are linearly formed, electric fields are concentrated on the ends of the sub shields 12 and 12, as shown in FIG. 3, which may cause a dielectric breakdown.

SUMMARY OF THE INVENTION

Therefore, an aspect of the detailed description is to provide a vacuum interrupter capable of enhancing a dielectric strength by varying an electric field distribution and simultaneously mitigating concentration of an electric field strongly generated at edges of electrodes in a manner of adjusting structure and arrangement of an inner shield even if the vacuum interrupter extends in length due to an increase in a rated voltage.

To achieve these and other advantages and in accordance with the purpose of this specification, as embodied and broadly described herein, a vacuum interrupter including a dielectric casing, a plurality of flanges configured to seal both ends of the dielectric casing, a stationary electrode fixed within the dielectric casing, a movable electrode disposed to face the stationary electrode, the movable electrode being slidabe with respect to the dielectric casing, a main shield fixed to the dielectric casing to house the stationary electrode and the movable electrode therein, a stationary-side sub shield disposed at one side of the main shield in an axial direction, the stationary-side sub shield fixed to the dielectric casing, and a movable-side sub shield fixed to the dielectric casing, the movable-side sub shield facing the stationary-side sub shield, wherein a curved portion is formed at least at an end of the main shield, the stationary-side sub shield or the movable-side sub shield.

In another aspect of this specification, there is provided a vacuum interrupter including a dielectric casing, a plurality of flanges configured to seal both ends of the dielectric casing, a stationary electrode fixed within the dielectric casing, a movable electrode disposed to face the stationary electrode, the movable electrode being slidabe with respect to the dielectric casing, a main shield fixed to the dielectric casing to house the stationary electrode and the movable electrode therein, a stationary-side sub shield disposed at one side of the main shield in an axial direction, the stationary-side sub shield fixed to the dielectric casing, and a movable-side sub shield fixed to the dielectric casing, the movable-side sub shield facing the stationary-side sub shield, wherein the main shield, the stationary-side sub shield and the movable-side sub shield have openings at both ends, at least one of the both openings being narrowed internally or extended externally.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of an inner shield for a vacuum interrupter in accordance with the exemplary embodiments, with reference to the accompanying drawings. For the sake of brief description with reference to the drawings, the same or equivalent components will be provided with the same reference numbers, and description thereof will not be repeated.

Figure 1:
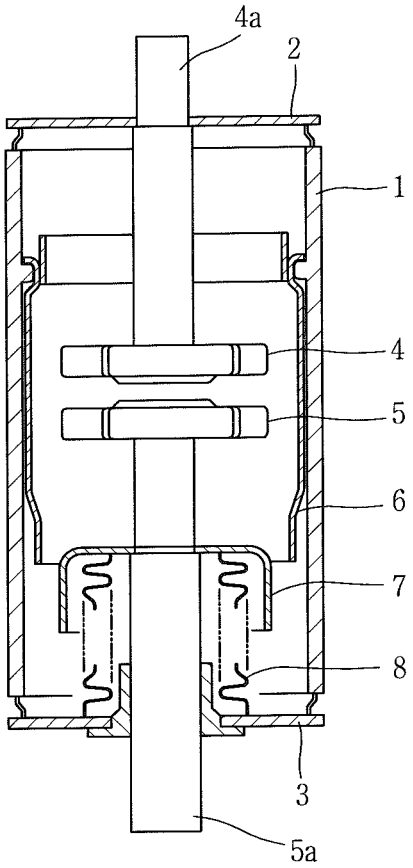
FIG. 1 PRIOR ART
FIG. 1 is a longitudinal sectional view showing a structure of a typical vacuum interrupter.
Figure 2:
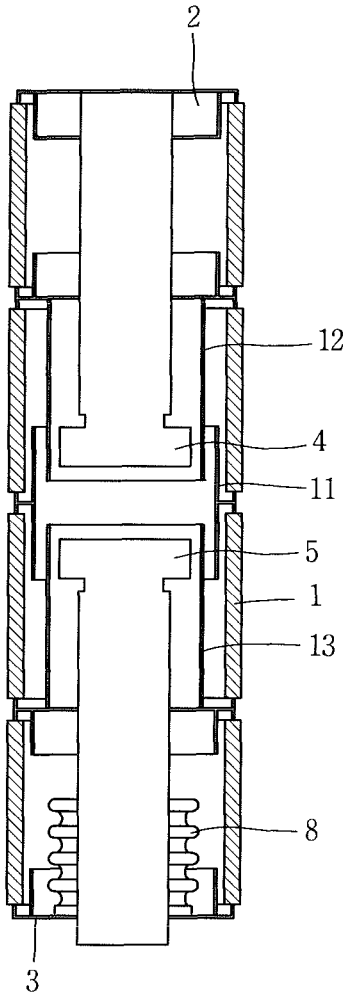
FIG. 2 PRIOR ART
FIG. 2 is a longitudinal sectional view showing another exemplary structure of a vacuum interrupter according to the related art.
Figure 3:
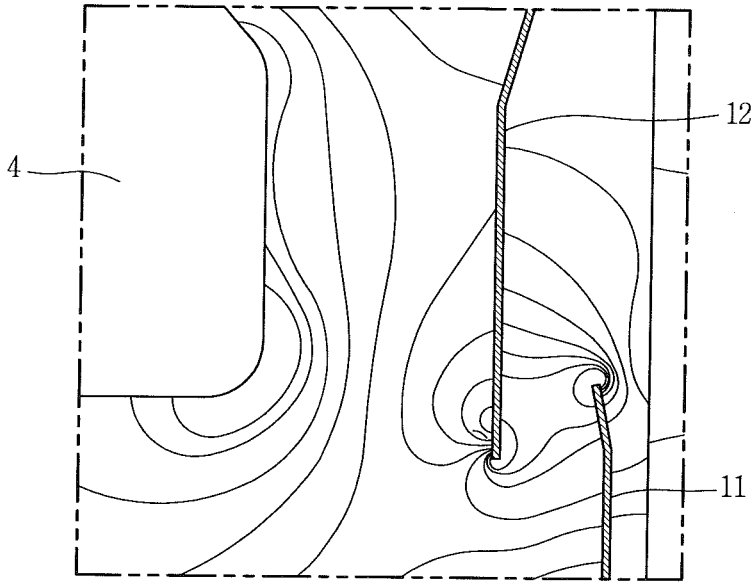
FIG. 3 PRIOR ART
FIG. 3 is a view showing an electric field distribution around shields in the vacuum interrupter of FIG. 2.
Figure 4:
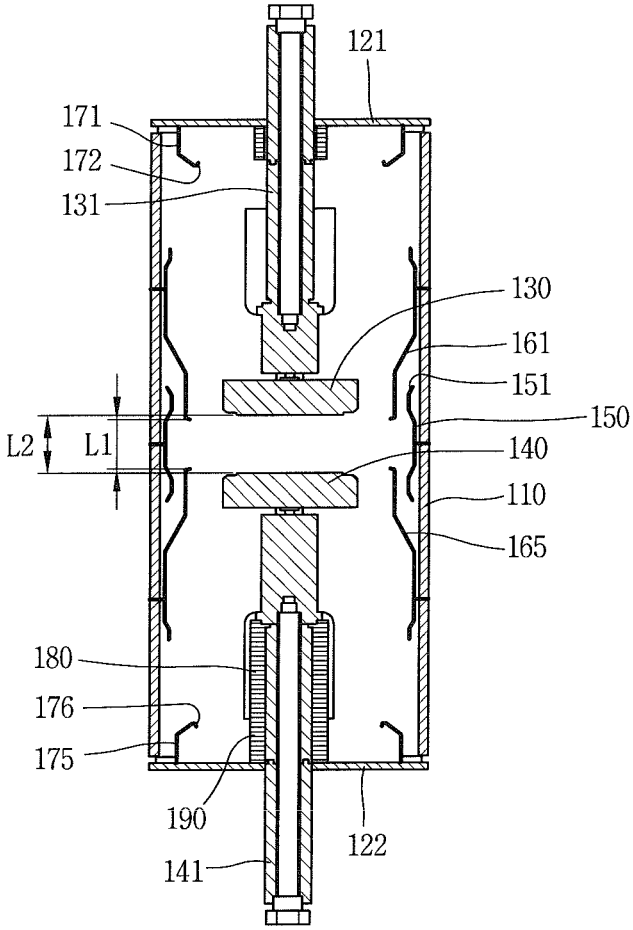
FIG. 4 is a longitudinal sectional view of a vacuum interrupter in accordance with this specification.

FIG. 4 is a longitudinal sectional view of a vacuum interrupter in accordance with this specification.

As shown in FIG. 4, the vacuum interrupter may include a dielectric casing 110 formed of ceramic, having openings at both ends. Both openings of the dielectric casing 1 may be sealed with a fixed flange 121 and a movable flange 122, respectively.

A stationary electrode 130 and a movable electrode 140 may be disposed within the dielectric casing 1 to face each other. The stationary electrode 130 may be fixed by a stationary shaft 131, which extends at one side surface of the stationary electrode 130 and penetrates the fixed flange 121. The movable electrode 140 may be slidably coupled to a movable shaft 141, which extends at one side surface of the movable electrode 140 and penetrates the movable flange 122.

A main shield 150 may be fixed within the dielectric casing 110 to house the fixed electrode 130 and the movable electrode 140. A stationary-side sub shield (hereinafter, referred to as a first sub shield) 161 and a movable-side sub shield (hereinafter, referred to as a second sub shield) 165 may be fixed to the dielectric casing 110 at both sides of the main shield 150 in an axial direction.

The main shield 150 may have a middle part whose diameter D1 is the same as an inner diameter of the dielectric casing 110, thereby being closely adhered onto an inner circumferential surface of the dielectric casing 110. Also, the main shield 150 may have both end portions each being bent to have a diameter smaller than the diameter D1 of the middle part. Curved portions 151 may be formed at both ends of the main shield 150. The curved portions 151 may have an arcuate shape or a curved shape, which is leaned toward the stationary electrode 130 and the movable electrode 140. This formation may be favorable to prevent concentration of an electric field. Each of the curved portions 151, as shown in the drawings, may be curved toward a central line of the dielectric casing 110, but alternatively, formed toward an inner circumferential surface of the dielectric casing 110.

Figure 5:
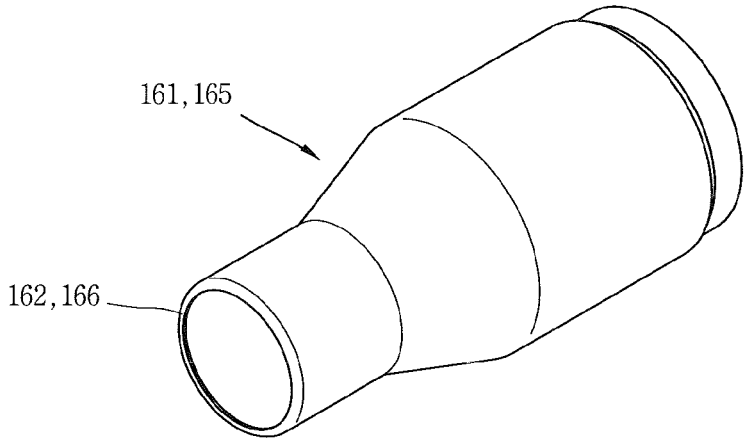
FIGS. 5 and 6 are a perspective view and a longitudinal sectional view respectively showing a sub shield according to FIG. 4.
Figure 6:
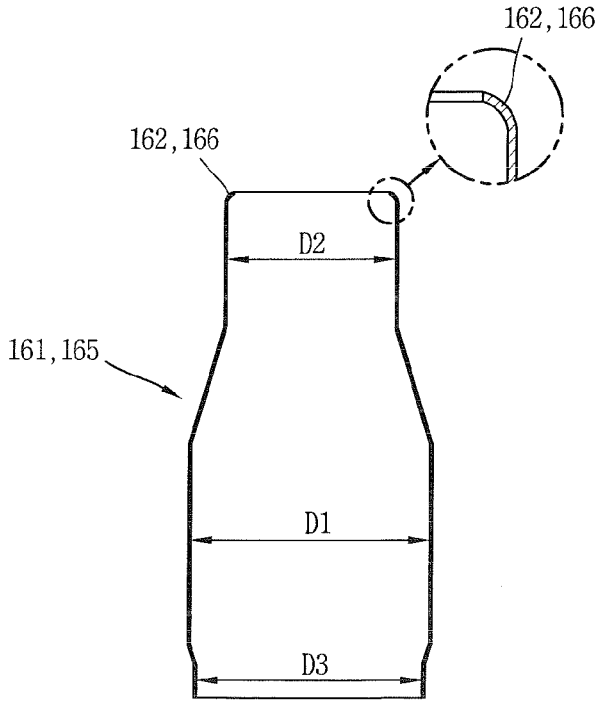

As shown in FIGS. 5 and 6, the first sub shield 161 and the second sub shield 165 may be symmetric to each other. A middle portion of each of the first and second sub shields 161 and 165 may have a diameter D1, which is the same as an inner diameter of the dielectric casing 110, so as to be closely adhered onto an inner circumferential surface of the dielectric casing 110 and fixed coupled thereto. On the other hand, one end portion of each of the first and second sub shields 161 and 165, especially, a first end portion facing the main shield 150, may have a diameter D2, which is smaller than the diameter of the main shield 150. Accordingly, the sub shields 161 and 165 each can be inserted by a predetermined length with a predetermined interval from an inner circumferential surface of both ends of the main shield 150. Another end portions of the respective first and second sub shields 161 and 165, especially, second end portions facing the flanges 121 and 122 may respectively have a diameter D3, which is defined as an intermediate value between the diameter D1 of the middle portion and the diameter D2 of the first end portion.

Here, a distance L1 between the first sub shield 161 and the second sub shield 165 should be shorter than a distance L2 between the stationary electrode 130 and the movable electrode 140.

Curved portions 162 and 166 may be formed at the first end portions of the first and second sub shields 161 and 165, respectively. The curved portions 162 and 166 may favorably have an arcuate shape or a curved shape toward the stationary electrode 130 and the movable electrode 140. This formation may prevent concentration of an electric field.

The curved portions 162 and 166 may be curved toward a central line of the dielectric casing 110 as shown in the drawings, but alternatively, curved toward an inner circumferential surface of the dielectric casing 110.

A stationary-side end shield (hereinafter, referred to as a first end shield) 171 and a movable-side end shield (hereinafter, referred to as a second end shield) 175 may be fixed to one side surfaces of the stationary flange 121 and the movable flange 122, respectively.

The first and second end shields 171 and 175 may be formed such that first end portions adjacent to the corresponding sub shields 161 and 165 can be bent towards the fixed shaft 131 and the movable shaft 141 so as for a diameter of each first end portion to be smaller than a diameter of each second end portion coupled to the fixed flange 121 and the movable flange 122. The first end shield 171 and the second end shield 175 may be spaced apart from the first sub shield 161 and the second sub shield 165 by predetermined intervals.

Here, end portions of the first and second end shields 171 and 175, namely, first end portions facing the first and second sub shields 161 and 165, may be provided with curved portions 172 and 176 having an arcuate shape or curved shape toward the fixed shaft 131 and the movable shaft 141, similar to the end portions of the first and second sub shields 161 and 165. Such formation may be favorable in view of preventing concentration of an electric field.

A bellows shield 180 may be fixed to the movable shaft 141 of the movable electrode 140. A bellows 190 may be inserted between the bellows shield 180 and the movable flange 122, thereby allowing the movable electrode 140 and the movable shaft 141 to be movable in a sealed state within the dielectric casing 110.

The inner shield for the vacuum interrupter according to this specification may have the following operational effects.

That is, in the structure of the vacuum interrupter, the first and second sub shields 161 and 165 are provided at both sides of the main shield 150 in the axial direction to overlap the main shield 150. The first end portions, namely, the electrode-side end portions of the first and second sub shields 161 and 165 are formed smaller in diameter than the main shield 150. Accordingly, an equipotential distribution may be mitigated, thereby improving a dielectric strength.

Figure 7:
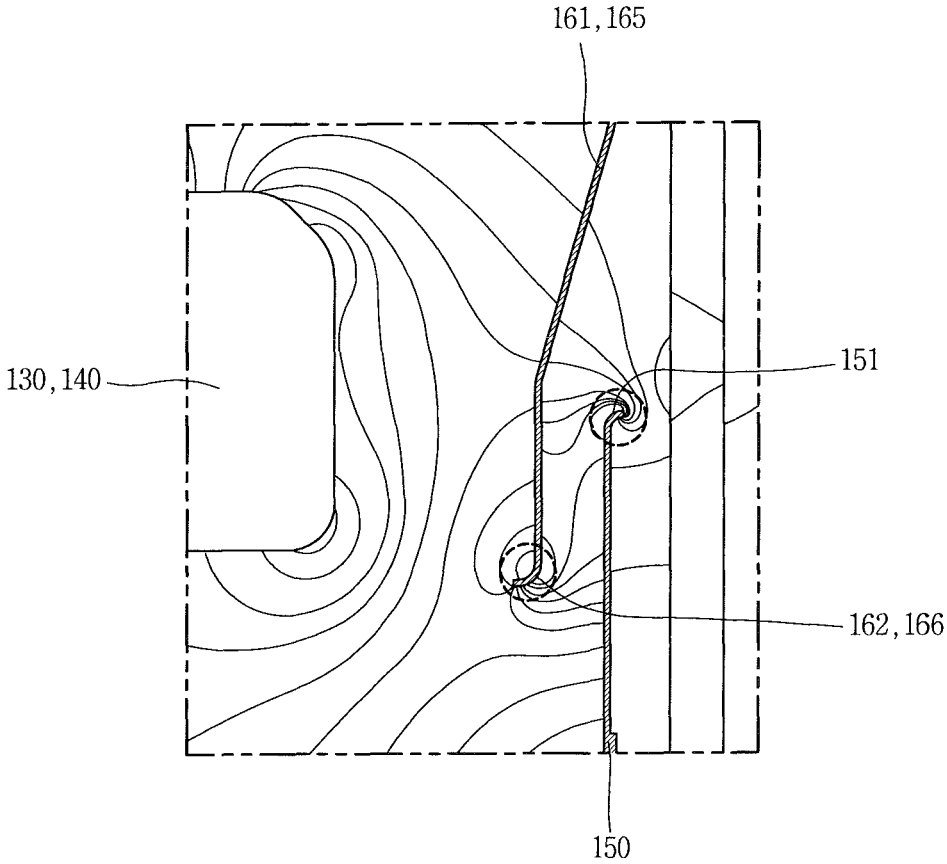
FIG. 7 is a view showing an electric field distribution around shields in the vacuum interrupter of FIG. 4.

Even in this case, however, if the electrode-side ends of the sub shields 161 and 165 are linearly formed as shown in the related art, an electric field may be concentrated on the end portions of the sub shields 161 and 165, which may be very unfavorable to insulation. To consider this drawback, as shown in this specification, when such curved portions 151, 162, 166 are formed at the electrode-side ends of the main shield 150 and the sub shields 161 and 162 facing the main shield 150, respectively, an electric field may be prevented from being concentrated on the ends of the main shield 150 or the sub shields 161 and 165, as shown in FIG. 7, thus to lower an electric field value. Accordingly, a dielectric strength can be remarkably improved and a dielectric breakdown can be effectively obviated.

Hereinafter, description will be given of another exemplary embodiment of an inner shield for a vacuum interrupter according to this specification.

Figure 8:
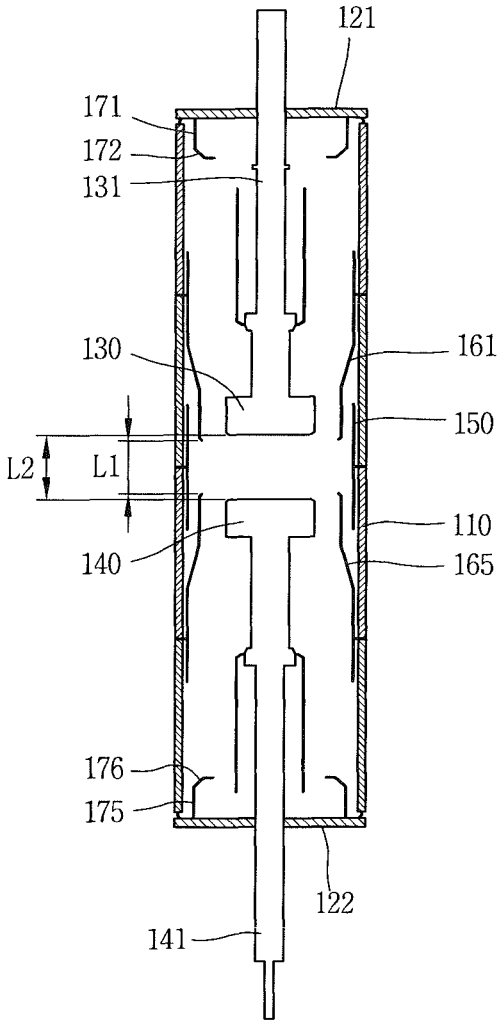
FIG. 8 is a longitudinal sectional view showing another exemplary embodiment of a vacuum interrupter.
Figure 9:
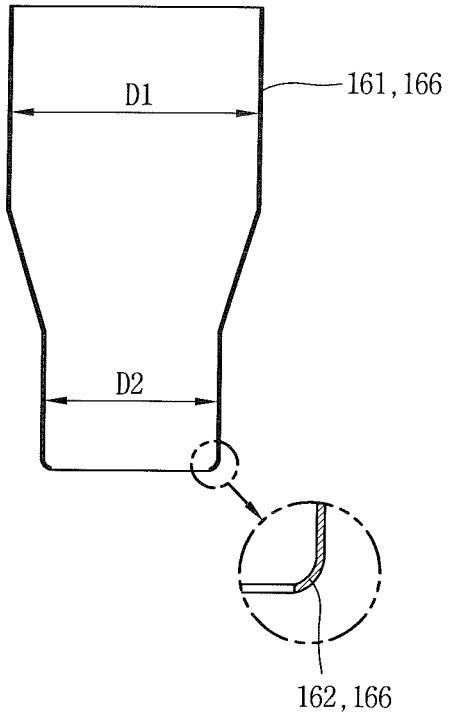
FIG. 9 is a longitudinal sectional view of a sub shield according to FIG. 8.

That is, the foregoing embodiment illustrates that the both end portions of the sub shields are smaller than the central portion thereof in diameter. However, this exemplary embodiment illustrates, as shown in FIGS. 8 and 9, that only a diameter D2 of the electrode-side end of both ends of each sub shields 161 and 162, namely, the first end portion overlapping the main shield 150, may be smaller than a diameter D1 of a central portion of each sub shield 161 and 162, and a diameter of the second end portion is the same as the diameter D1 of the central portion thereof.

This structure can ensure almost the same effect of mitigating the equipotential distribution of the sub shields 161 and 165 and also the shape of each sub shield 161 and 165 can be simplified, which results in facilitation of fabrication.

Consequently, the vacuum interrupter according to this specification can improve a dielectric strength by mitigating the equipotential distribution by installing the main shield and the sub shields in the overlapping manner. In addition, the curved portions are formed at the ends of the shields so as to prevent concentration of the electric fields on the end of each shield. The electric field value can thusly be lowered, which allows the dielectric strength to be remarkably improved, resulting in an effective prevention of a dielectric breakdown.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A vacuum interrupter comprising:

a dielectric casing;

a plurality of flanges each configured to seal one end of the dielectric casing;

a stationary electrode fixed within the dielectric casing;

a movable electrode located such that it faces the stationary electrode and is slidable with respect to the dielectric casing;

a main shield fixed to the dielectric casing in order to house the stationary electrode and the movable electrode;

a stationary-side sub shield fixed to the dielectric casing and located at one side of the main shield in an axial direction; and a movable-side sub shield facing the stationary-side sub shield and fixed to the dielectric casing, wherein a curved portion is formed at an end of at least the main shield, the stationary-side sub shield or the movable-side sub shield, wherein an end of each of the stationary-side sub shield and the movable-side sub shield is inserted into the main shield in order to overlap the main shield by a predetermined length, and wherein each of the stationary-side sub shield and the movable-side sub shield comprises:

a middle portion fixed to the dielectric casing;

a first end portion inserted into the main shield and having a diameter that is smaller than a diameter of the middle portion; and a second end portion located opposite to the first end portion and having a diameter that is greater than a diameter of the first end portion and smaller than the diameter of the middle portion.

2. The vacuum interrupter of claim 1, wherein the curved portion has a curved section.

3. The vacuum interrupter of claim 1, wherein the curved portion of each of the main shield, the stationary-side sub shield and the movable-side sub shield face opposite directions.

4. The vacuum interrupter of claim 3, wherein:

the curved portion of the main shield is curved toward an inner circumferential surface of the dielectric casing; and the curved portion of each of the stationary-side sub shield and the movable-side sub shield is curved toward a central line of the dielectric casing.

5. The vacuum interrupter of claim 1, wherein an interval between the stationary-side sub shield and the movable-side sub shield is narrower than an interval between the stationary electrode and the movable electrode.

6. The vacuum interrupter of claim 1, further comprising a stationary-side end shield fixed to a fixed flange and a movable-side end shield fixed to a movable flange, wherein a curved portion is formed at an end of at least the stationary-side end shield or the movable-side end shield.

7. The vacuum interrupter of claim 6, wherein:

the stationary-side end shield is spaced apart from the stationary-side sub shield by a first predetermined interval; and the movable-side end shield is spaced apart from the movable-side sub shield by a second predetermined interval.

8. The vacuum interrupter of claim 7, wherein at least one curved portion of a curved portion of the stationary-side end shield or movable-side end shield has a curved section.

9. The vacuum interrupter of claim 7, wherein the curved portion is curved toward a central line of the dielectric casing.

10. A vacuum interrupter comprising:

a dielectric casing;

a plurality of flanges each configured to seal one end of the dielectric casing;

a stationary electrode fixed within the dielectric casing;

a movable electrode located such that it faces the stationary electrode and is slidable with respect to the dielectric casing;

a main shield fixed to the dielectric casing in order to house the stationary electrode and the movable electrode;

a stationary-side sub shield fixed to the dielectric casing and located at one side of the main shield in an axial direction; and a movable-side sub shield facing the stationary-side sub shield and fixed to the dielectric casing, wherein the main shield, the stationary-side sub shield and the movable-side sub shield each has openings at both ends, at least one of the corresponding openings narrowed internally or extended externally, wherein an end of each of the stationary-side sub shield and the movable-side sub shield is inserted into the main shield in order to overlap the main shield by a predetermined length, and wherein each of the stationary-side sub shield and the movable-side sub shield comprises:

a middle portion fixed to the dielectric casing;

a first end portion inserted into the main shield and having a diameter that is smaller than a diameter of the middle portion; and a second end portion located opposite to the first end portion and having a diameter that is greater than a diameter of the first end portion and smaller than the diameter of the middle portion.

11. The vacuum interrupter of claim 10, wherein the curved portion has a curved section.

12. The vacuum interrupter of claim 10, wherein the curved portion of each of the main shield, the stationary-side sub shield and the movable-side sub shield face opposite directions.

13. The vacuum interrupter of claim 10, wherein an interval between the stationary-side sub shield and the movable-side sub shield is narrower than an interval between the stationary electrode and the movable electrode.

14. The vacuum interrupter of claim 10, further comprising a stationary-side end shield fixed to a fixed flange and a movable-side end shield fixed to a movable flange, wherein a curved portion is formed at an end of at least the stationary-side end shield or the movable-side end shield.

15. The vacuum interrupter of claim 14, wherein:

the stationary-side end shield is spaced apart from the stationary-side sub shield by a first predetermined interval; and the movable-side end shield is spaced apart from the movable-side sub shield by a second predetermined interval.

* * * * *